US005495839A

United States Patent [19]

Samejima et al.

[11] Patent Number: 5,495,839

[45] Date of Patent: Mar. 5, 1996

[54] ENGINE FUEL INJECTION CONTROLLER

[75] Inventors: Satoshi Samejima, Yokohama; Hirofumi Tsuchida; Koji Ishihara, both of Yokosuka, all of Japan

[73] Assignee: Nissan Motor Co., Ltd., Yokohama, Japan

[21] Appl. No.: 295,601

[22] Filed: Aug. 10, 1994

[30] Foreign Application Priority Data

Aug. 19, 1993 [JP] Japan ..... 5-205332

[51] Int. Cl.[6] ..... F02M 51/00

[52] U.S. Cl. ..... 123/478; 123/480

[58] Field of Search ..... 123/478, 480, 123/481, 435; 364/431.01

[56] References Cited

U.S. PATENT DOCUMENTS 5,115,781 5/1992 Kurita et al. ..... 123/481
5,270,935 12/1993 Dudek et al. ..... 364/431.01
5,337,719 8/1994 Togai ..... 123/478
5,394,849 3/1995 Tomisawa ..... 123/435
5,404,856 4/1995 Servati ..... 123/478

*Primary Examiner*—Raymond A. Nelli
*Attorney, Agent, or Firm*—Foley & Lardner

[57] ABSTRACT

The delay of fuel flow in an intake passage of an engine is divided into two categories, namely a short-term delay having a relatively fast time constant and a long-term delay having a relatively slow time constant. The corrections for each delay are stored separately depending on the engine running conditions. A mechanism is provided for estimating the particle diameter of the fuel spray, and either the long-term delay correction is modified so that it increases or the short-term delay correction is modified so that it decreases as the particles of fuel spray become smaller. The basic fuel injection amount during transient engine running conditions is corrected by applying the delay flow correction thereby modified, and error in the air-fuel ratio during transient conditions due to atomization of fuel particles is prevented.

6 Claims, 17 Drawing Sheets

| No | LINE | SPRAY PARTICLE DIA. |
|---|---|---|
| (1) | ——— | LARGE |
| (2) | - - - - | ↕ |
| (3) | — - — | SMALL |

ENGINE FUEL INJECTION CONTROLLER

FIELD OF THE INVENTION

This invention relates to an engine fuel control unit, and more specifically to a wall flow correction for controlling the fuel injection amount during transient running conditions.

BACKGROUND OF THE INVENTION

In an internal combustion engine provided with a fuel injector, injected fuel is supplied to the cylinder from all intake port by spraying it into the intake air. However, as the fuel is originally in the liquid form, part of it adheres as liquid to the intake port or intake valve, and it therefore enters the cylinder in a different form to that of the fuel in the air-fuel mixture. This flow of liquid fuel, or wall flow, requires a different time to reach the cylinder from the time required by the air-fuel mixture which is in spray form, and its entry into the combustion chamber is delayed in comparison to the air-fuel mixture. When the engine is running steadily under fixed conditions, this fuel delay has no effect on the air-fuel ratio in the combustion chamber, but under transient conditions such as during acceleration or deceleration for example, the difference in the rate at which the air-fuel spray and the wall flow reach the cylinder causes the air-fuel ratio of the mixture in the cylinder to fluctuate between rich and lean, and this has an adverse effect on the composition of the engine exhaust and output.

Hence during acceleration, part of the injected fuel becomes wall flow, which causes a delay in the fuel increase with respect to the increased air flow into the cylinder, and the air-fuel ratio shifts to lean. During deceleration on the other hand, due to the wall .flow, the decrease of fuel is delayed with respect to the decrease of air flowing into the cylinder, so the air-fuel ratio shifts to rich. Moreover, not all of the air-fuel spray enters the cylinder uniformly, and part of it becomes a slow-moving flow between the cylinder injector and the cylinder. This also gives rise to some delay compared to the flow of intake air.

The delay in the fuel supply to the cylinder due to adhesion or slow movement of fuel may vary depending on for example the fuel composition, engine temperature or the structure of the intake passage. Broadly speaking, however, a short-term delay having a relatively fast time constant and small delay, and a long-term delay having a relatively slow time constant and a large delay, may be distinguished. For example, FIG. 22 shows the change of air-fuel ratio with respect to intake throttle opening during acceleration. As shown by the curve (1) in the drawing, the effect of the short-term delay appears immediately after the throttle opening is changed, and the effect of the long-term delay appears subsequently.

Therefore, by separating the flow delay due to adhesion and slow movement of fuel into a short-term delay having a relatively small (fast) time constant and a long-term delay having a relatively large (slow) time constant, and performing a wall flow correction of the fuel injection amount during transient conditions for each type of delay, high precision air-fuel ratio control can be achieved.

More specifically, the fuel injection pulse width Ti of the fuel injector is given by the following equation:

$$Ti=(Tp+Kl+Kh)*\alpha+Ts$$

where:

Tp=basic injection pulse width

Kl=long-term delay flow correction

Kh=short-term delay flow correction $\alpha$=air-fuel ratio feedback control coefficient Ts=ineffectual pulse width In this equation, the two corrections Kl and Kh may both be predicted from the running conditions determined by the engine speed Ne, injector air flow (corresponding to the engine load) $Q_{AINJ}$ and the engine cooling water temperature Tw, and may be found by learning. During acceleration, as seen in FIG. 21, the short-term delay flow correction Kh is first learnt in the initial stage of the acceleration, the long-term delay flow correction Kl is then learnt, and a correction is performed based mainly on these learnt values. The air-fuel ratio is thereby corrected to a target air-fuel ratio as shown in FIG. 22, curve (1).

The separation of the delay flow into two types as hereintofore described and the application of separate transient corrections for the two types of flow, is disclosed for example in Tokkai Sho 63-38635 published by the Japanese Patent Office.

This correction method, however, does not properly work for an air-assisted injector, which is a fuel injector provided with a supplemental air supply for promoting atomization of fuel at the moment of fuel injection. This type of injector is known to improve the performance of an engine under steady state running conditions.

When this air-assisted injector is used, however, as the diameter of fuel spray particles becomes smaller, the delay flow time constants also vary.

Consequently, when the aforementioned correction process is applied to an air-assisted injector, an air-fuel ratio error arises as shown in the lowermost part of FIG. 22. This figure shows the relation between the throttle opening Tvo during acceleration, the fuel injection pulse width (value expressing the fuel injection amount) Ti and the air-fuel ratio before and after applying a transient correction. Curve (1) shows the air-fuel ratio in a standard injector, curve (2) shows the air-fuel ratio using an air-assisted injector wherein the fuel particles are relatively large, and curve (3) shows the air-fuel ratio using an air-assisted injector wherein the fuel particles are relatively small.

As can be seen from this figure, when the air-assisted injector is used, the air-fuel ratio tends to be too rich in the initial stage of acceleration, and to be too lean in the later stage of acceleration. This is due to the fact that the corrections Kl and Kh were set without considering differences in the atomization level of the fuel.

SUMMARY OF THE INVENTION

It is therefore an object of this invention to prevent air-fuel ratio errors under transient conditions when an a-assisted injector is used.

It is another object of this invention to prevent air-fuel ratio errors due to intake pressure variations downstream of the throttle and to variations of supplemental air flowrate when an air-assisted injector is used.

It is yet another object of this invention to precisely control the fuel injection amount during transient conditions in an air-assisted injector using the same delay correction map as for the standard type injectors.

In order to achieve the above objects, this invention provides an engine fuel injection controller for use with am engine comprising a cylinder, an intake passage provided with an intake valve for aspirating air into the cylinder, a throttle for regulating an air flowrate ill the passage, an injector situated between the throttle and the intake valve for injecting fuel into the passage, and a mechanism for promoting atomization of the fuel spray from the injector.

The controller comprises a mechanism for detecting engine running conditions, a mechanism for computing a basic fuel injection arnotrot based on the engine running conditions, a mechanism for storing short-term delay flow corrections depending on various engine running conditions, each of the corrections corresponding to a delay of fuel flow in the passage with a relatively fast time constant, a mechanism for storing long-term delay flow corrections depending on various engine running conditions, each of the corrections corresponding to a delay of fuel flow ill the passage with a relatively slow time constant, a mechanism for reading a short-term delay flow correction from the short-term flow correction storing mechanism based on the detected engine running conditions, a mechanism for reading a long-term delay flow correction from the long-term flow correction storing mechanism based on the detected engine running conditions, a mechanism for estimating a particle diameter of the fuel spray, a mechanism for modifying at least one of the read delay flow corrections such that the long-term delay flow correction is increased, and the short-term delay flow correction is decreased, the smaller the particle diameter of the fuel spray, a mechanism for correcting the basic injection amount based on the modified delay flow corrections, and a mechanism for controlling the injector to inject the corrected amount of fuel.

Preferably, the atomization promoting mechanism comprises a device for mixing supplemental air with the fuel injected by the injector, and the particle diameter estimating mechanism comprises a mechanism for detecting a flowrate of the supplemental air, a mechanism for detecting either the difference or ratio of a pressure of the supplemental air and a pressure in the passage downstream from the throttle valve, and a mechanism for estimating the particle diameter based on the pressure difference or ratio and the supplemental air flowrate.

This invention also provides an engine fuel injection controller comprising a mechanism for detecting engine running conditions, a mechanism for detecting a temperature of a part of the passage where sprayed fuel has adhered, a mechanism for computing a basic fuel injection amount based on the engine running conditions, a mechanism for storing short-term delay flow corrections depending on various engine running conditions and temperatures of a part where fuel is adhering, each of the corrections corresponding to a delay of fuel flow in the passage with a relatively fast time constant, a mechanism for storing long-term delay flow corrections depending on various engine running conditions and temperatures of a part where fuel is adhering, each of the corrections corresponding to a delay of fuel flow in the passage with a relatively slow time constant, a mechanism for reading a short-term delay flow correction from the sort-term delay flow corrections storing mechanism based on the detected engine running conditions and the detected temperature, a mechanism for reading a long-term delay flow correction from the long-term delay flow corrections storing mechanism based on the detected engine running conditions and the detected temperature, a mechanism for estimating a particle diameter of the fuel spray, a mechanism for modifying at least one of the read delay flow corrections such that the long-term delay flow correction is increased, and the short-term delay flow correction is decreased, the smaller the particle diameter of the fuel spray, a mechanism for correcting the basic injection amount based on the modified delay flow corrections, and a mechanism for controlling the injector to inject the corrected amount of fuel.

The temperature detecting mechanism comprises for example a mechanism for detecting a temperature of the intake valve.

Alternatively, the temperature detecting mechanism comprises a mechanism for detecting an engine cooling water temperature, a mechanism for detecting a temperature of the intake passage, a mechanism for calculating an equilibrium temperature of the aforesaid part from the cooling water temperature and the intake passage temperature, and a mechanism for applying a first order delay at a predetermined rate to the equilibrium temperature.

Also alternatively, the temperature detecting mechanism comprises a mechanism for detecting an engine cooling water temperature, a mechanism for setting an initial value of the temperature of the aforesaid part when the engine starts up, and a mechanism for computing the temperature of the part from the set initial value and the cooling water temperature.

The details as well as other features and advantages of this invention are set forth in the remainder of the specification and are shown in the accompanying drawings.

DESCRIPTION OF THE PREFERRED EMBODIMENTS

Figure 1:
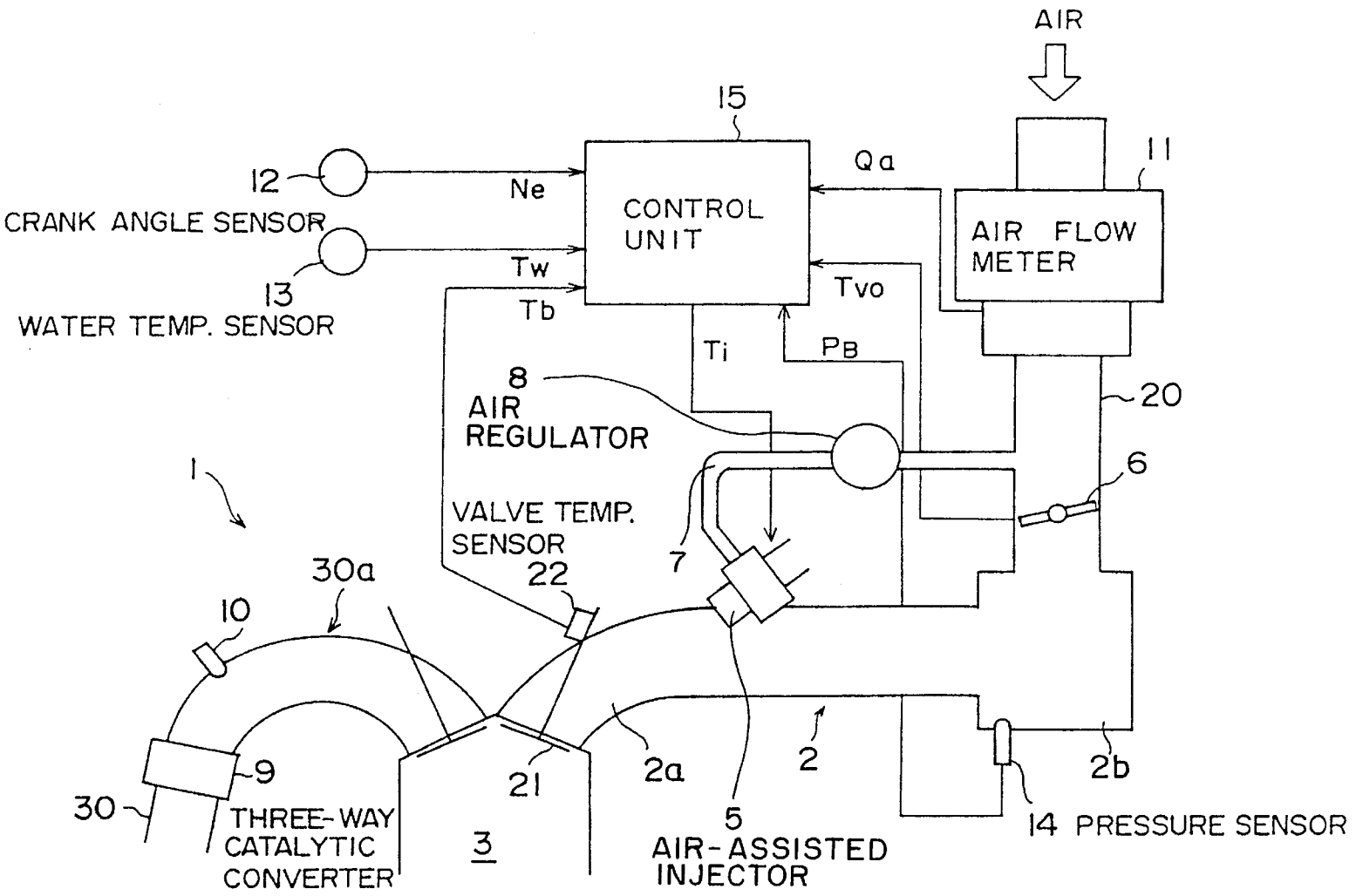
FIG. 1 is a schematic diagram of a fuel injection controller according to this invention.

Referring to FIG. 1 of the drawings, an intake air passage 20 is connected via an intake air manifold 2, and an exhaust gas passage 30 is connected via an exhaust gas manifold 30*a*, to a cylinder 3 of an engine 1. An air flow meter 11 for detecting intake air flowrate Qa and a throttle 6 for regulating an intake air amount are installed at intermediate points in the intake air passage 20. Also, a three-way catalytic converter 9 for converting toxic components of the exhaust gas and an $O_2$ sensor 10 for detecting fluctuations of air-fuel ratio in the combustion chamber from the oxygen concentration of the exhaust gas, are installed in the exhaust gas passage 30.

The intake air manifold 2 is connected to the cylinder 3 via an intake port 2*a*. An air-assisted injector 5 is provided in the intake air port 2*a*, fuel being intermittently injected from the injector 5 towards the intake air port 2*a* in synchronism with the engine revolution.

The construction of the injector 5 is no different from that of a standard injector excepting for the fact that supplemental air is supplied to the injector when it injects fuel. The adjustment of the fuel injection amount may for example be performed by varying the length of time for which the injector 5 is open. Fuel which is supplied to the injector 5 is pressurized by a high pressure pump, not shown. In order to control the fuel injection amount when the injector 5 is open, the fuel supply pressure to the 2 intake manifold 2 must be held constant regardless of the intake negative pressure, i.e. regardless of pressure variations downstream of the throttle 6. For this purpose, a pressure regulator, not shown, installed in the fuel supply line, holds the fuel injection pressure constant at a fixed value (e.g. 2.55 kg/cm$^2$) above the intake negative pressure.

An auxiliary air passage 7 which bypasses the throttle 6 is provided to supply supplemental air to the injector 5, and an air regulator 8 is installed in the passage 7 to adjust the amount of air supplied. The more the supplemental air is supplied to the injector 5, the smaller the diameter of fuel particles from the injector 5, and the higher the degree of particle atomization.

The opening of the air regulator 8 is varied according to the cooling water temperature Tw, the regulator being controlled so that its opening increases the lower the cooling water temperature Tw. This opening is effectively proportional to the amount of supplemental air passing through the regulator 8 to the injector, the amount of supplemental air being increased so as to promote atomization of fuel the lower the cooling water temperature Tw.

An intake valve 21 is installed in the intake port 2A, air measured by the air flow meter 11 flowing into the cylinder 3 via the intake valve 21 from the port 2A which is situated at the end of one branch of the intake manifold 2.

The concentration of the fuel-air mixture, i.e. the air-fuel ratio, shifts to rich when the fuel injection amount increases and shifts to lean when the fuel injection amount decreases with respect to a fixed intake air volume. If a basic injection amount is determined such that the ratio of fuel to intake air is a constant value, therefore, the same air-fuel ratio will be obtained even if the running conditions are different. When one fuel injection is performed for one engine revolution, a basic injection pulse width Tp with respect to the air volume taken into the cylinder during one revolution is found from the running conditions at that time. The air-fuel ratio determined by this parameter Tp is normally set to be in the vicinity of the theoretical (stoichiometric) a-fuel ratio so that the three-way catalytic converter 9 gives its maximum performance.

In order to perform the above-mentioned air-fuel ratio control, the air flow meter 11, a crank angle sensor 12 for outputting a signal every unit crank angle and a basic crank angle position, a sensor 13 for detecting the cooling water temperature Tw, a sensor 14 for detecting the intake negative pressure $P_B$, a throttle opening sensor for detecting the throttle opening Tvo and a temperature sensor 22 for detecting the temperature Tb of the intake valve 21 are provided, the signals from these devices being input together with the signal from the $O_2$ sensor 10 to a control unit 15.

The control unit 15, which comprises a microprocessor, determines the basic injection pulse width Tp based on these signals. The air-fuel ratio is also feedback-controlled based on the signal from the $O_2$ sensor 10, and the precision of controlling the air-fuel ratio to the theoretical air-fuel ratio is enhanced by means of learning.

The control unit 15 corrects the air-fuel ratio during transient conditions by separating the correction into a short-term delay flow correction Kh with a fast time constant, and a long-term delay flow correction Kl with a slow time constant. The short-term delay flow correction deals for example with fuel floating in the gas around the intake port 2*a*, whereas the long-term delay flow correction deals with fuel adhering to the wall of the port 2*a* which moves slowly.

For this purpose, the control unit 15 computes the particle diameter in the fuel spray from the injector 5, and separately modifies the map values of the wall flow corrections Kl and Kh according to this diameter.

Figure 2:
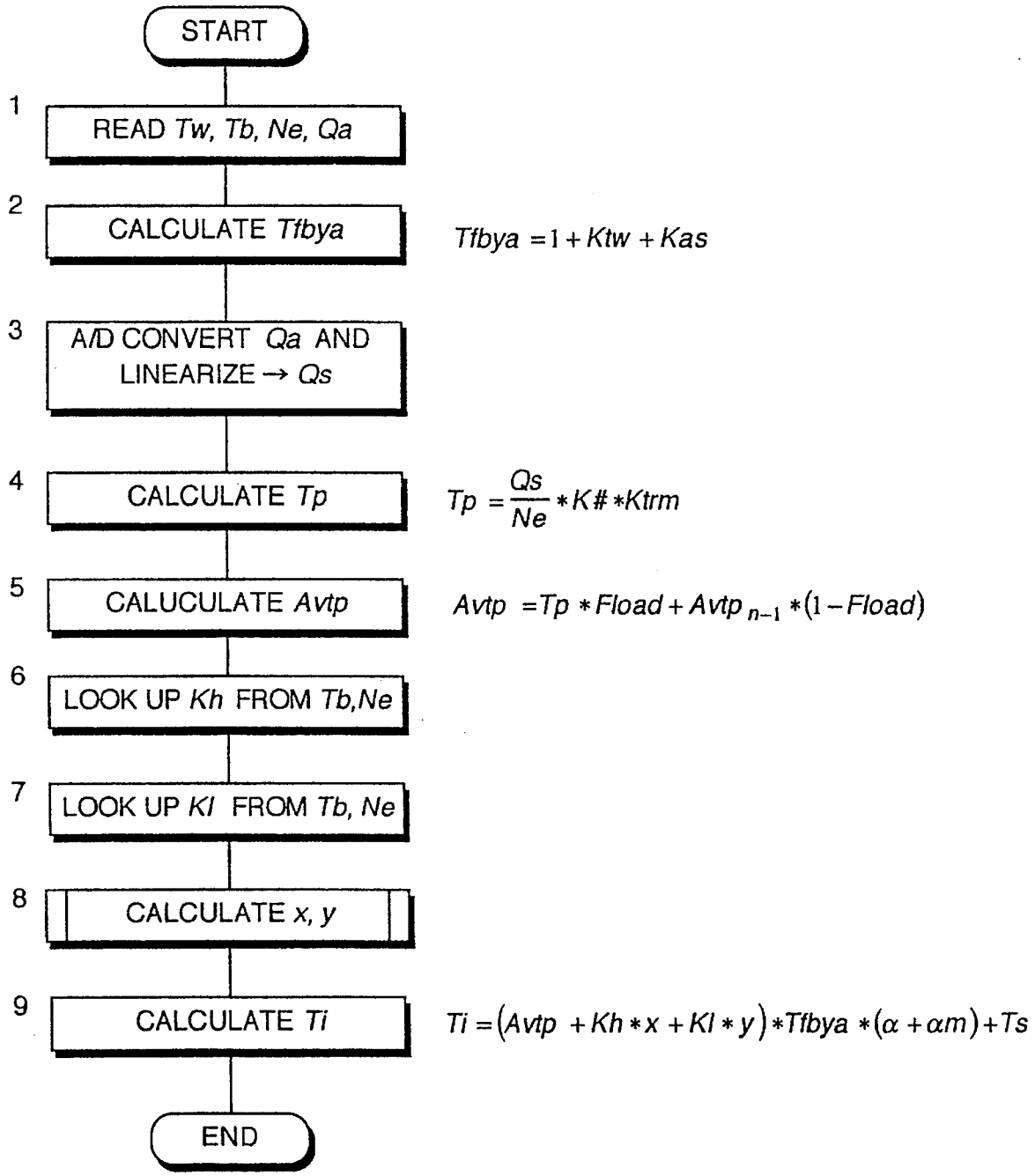
FIG. 2 is a flowchart describing a process of computing a fuel injection pulse width Ti according to this invention.

Next, the modification of this correction and the control of fuel injection amount by the control unit 15 will be described with reference to the flowchart of FIG. 2. This routine is executed at fixed intervals (e.g. every 10 ms).

First, the air flow meter output Qa, engine speed Ne, cooling water temperature Tw and valve temperature Tb are read. The engine speed Ne is found from an input signal supplied by the crank angle sensor 12.

The valve temperature Tb is used as a value for expressing the temperature in the part of the intake port 2*a* where there is fuel adhering to the wall. When it is difficult to directly determine the temperature in this part of the system, an equilibrium temperature Th of the part may be found from the cooling water temperature Tw and intake air temperature Ta, and a temperature prediction value Tf of the part calculated with a first order delay. This technique is described in Tokkal Hei 1-305 142 published by the Japanese Patent Office.

Alternatively, if an initial value is suitably chosen when the engine is started mid this is made to approach the cooling water temperature with a first order delay, this value exhibits a variation which closely resembles the temperature variation in the part of the port 2*a* where fuel is adhering to the wall. A simpler method is then to calculate a value Tbl from the equation below which may be used as the temperature prediction value:

$$Tbl=Tbl_{-1sec}+(Tw-Tbl_{-1sec})*Tblh$$

where: Tbl=temperature prediction value of part of port where fuel is adhering to wall $Tbl_{-1sec}$=value of Tbl one second before Tw=cooling water temperature Tblh=correction rate This calculation is performed every 1 second independently of the routine of FIG. 2.

Next, a target air-fuel ratio Tfbya is calculated by the following relation (step 2):

$$TJbya=1+KTw+Kas$$

where: KTw=water temperature increase correction coefficient

Kas=increase correction coefficient after start-up

The target air-fuel ratio Tfbya is a relative value based on a value of 1 for the theoretical air-fuel ratio. The value Kas of the increase correction coefficient after start-up is determined according to the cooling water temperature Tw during the period when the starting motor is driving the engine, and it gradually decreases with time immediately after engine start-up. The water temperature increase correction coefficient KTw is found from the cooling water temperature Tw by looking up a table, and it decreases as the cooling water temperature Tw increases.

Therefore, after warm-up is complete, the target air-fuel ratio TJbya=1 and is equal to the theoretical air-fuel ratio.

Next, after A/D conversion of the air flow meter output Qa, the basic injection pulse width Tp is calculated from the linearized air flowrate Qs (steps 3, 4):

$$Tp=(Qs/Ne)*K\#*Ktrm$$

where: K#=constant for determining basic air-fuel ratio

Ktrm=constant determined by injector flowrate properties

The cylinder air equivalent pulse width Avtp is then calculated using Tp (step 5).

$$Avtp=Tp*Fload+Avtp_{n-1}*(1-Fload)$$

where: $Avtp_{n-1}$=Avtp on immediately preceding occasion

Fload=weighting average coefficient

The above equation takes account of the fact that even if the intake flowrate changes in stepwise fashion at the position of the air flow meter 11, a first order delay arises in the air entering the cylinder due to the volume of the intake passage. Avtp expresses the fuel injection amount corresponding to the air entering the cylinder 3, in terms of the pulse width of the fuel injection signal input to the fuel injector 5. When the engine 1 is running under steady state conditions, Tp is identical to Avtp.

Next, the two delay flow corrections Kl and Kh are found by looking up maps from the valve temperature Tb and engine speed Ne (steps 6, 7).

The data for the two delay flow corrections Kl, Kh are matched for a standard injector, and are entered on maps as initialization values. Although an air-assisted injector is used, it is not necessary to rearrange this matching and the conventional map data may be used without modification.

Figure 3:
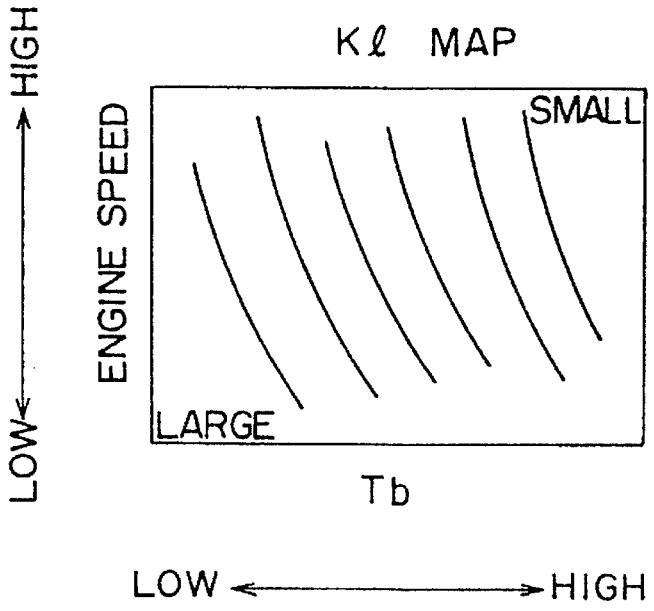
FIG. 3 is a graph showing an outline of a map of a long-term delay flow correction Kl according to this invention.
Figure 4:
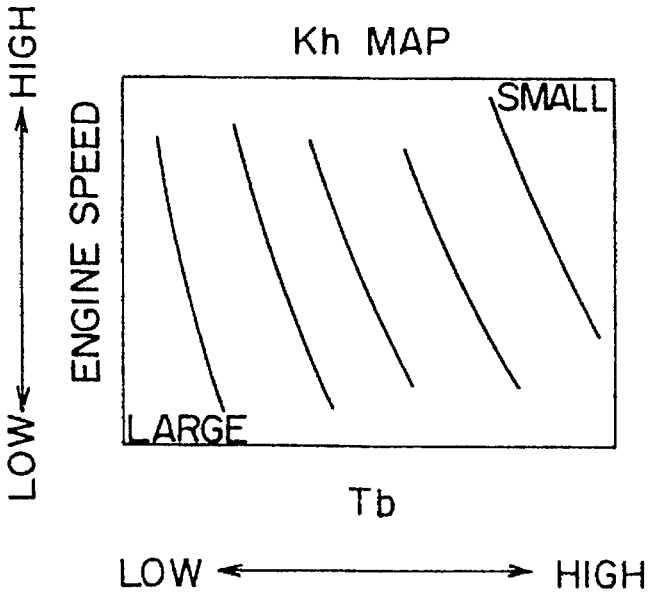
FIG. 4 is a graph showing an outline of a map of a short-term delay flow correction Kh according to this invention.

The map values of the delay flow corrections Kl, Kh are shown in FIG. 3 and FIG. 4, and both sets of values increase as the valve temperature Tb decreases. Also, for the same valve temperature Tb, the values decrease the higher the engine speed Ne.

Figure 5:
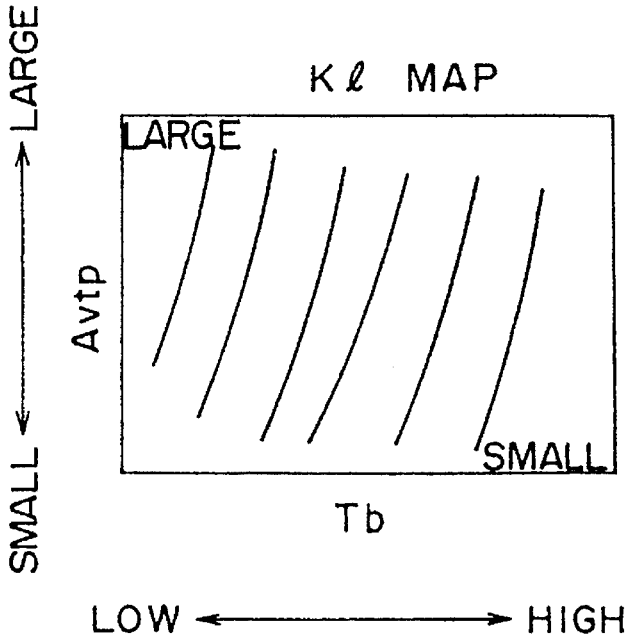
FIG. 5 is a graph showing an outline of a map of a long-term delay flow correction Kl according to a second embodiment of this invention.
Figure 6:
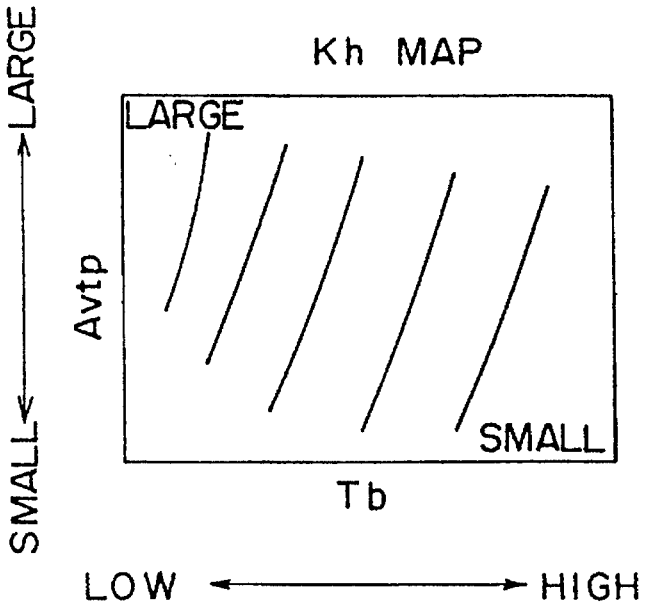
FIG. 6 is a graph showing an outline of a map of a short-term delay flow correction Kh according to the second embodiment of this invention.

In a second embodiment of this invention, maps of Kl and Kh may be set up using the cylinder air equivalent pulse width Avtp corresponding to the engine load and valve temperature Tb as parameters, as shown in FIG. 5 and FIG. 6.

In this case, the correction increases as Avtp increases even for the same valve temperature Tb.

Figure 7:
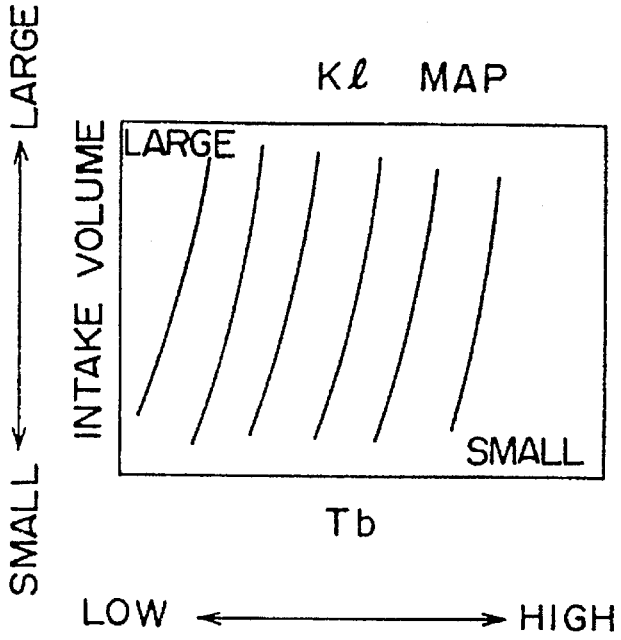
FIG. 7 is a graph showing an outline of a map of a long-term delay flow correction Kl according to a third embodiment of this invention.
Figure 8:
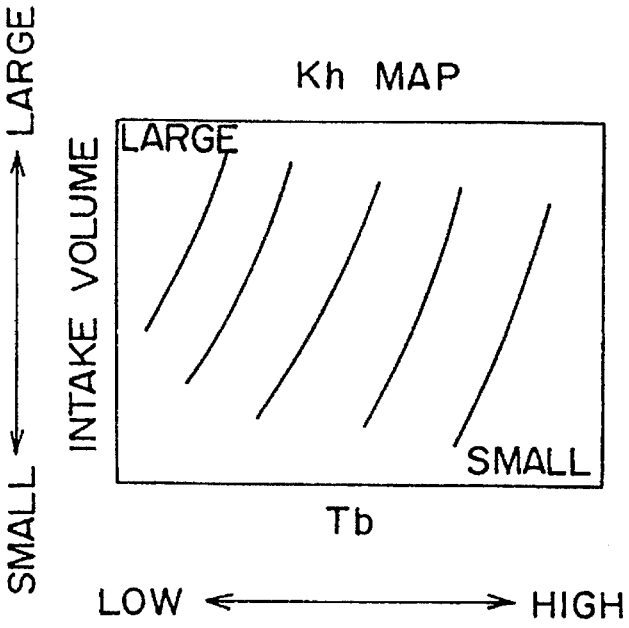
FIG. 8 is a graph showing an outline of a map of a short-term delay flow correction Kh according to the third embodiment of this invention.

In a third embodiment, maps of Kl and Kh may be set up using the intake volume instead of Avtp as shown in FIG. 7 and FIG. 8.

In any of the above embodiments, after looking up the corrections Kl, Kh, a fuel injection pulse width Ti is calculated by the following equation (steps 8, 9):

$$Ti=\{(Avtp+Kh*x+Kl*y)*Tfbya*(\alpha+\alpha m-1)\}+Ts$$

where: Kh=short-term delay flow correction x=atomization correction factor for Kh Kl=long-term delay flow correction y=atomization correction factor for Kl $\alpha$=air-fuel ratio feedback correction coefficient $\alpha m$=air-fuel ratio learning correction coefficient Ts=ineffectual pulse width The atomization correction factors x and y are newly introduced values for modifying the short-term delay flow correction and long-term delay flow correction depending on the degree of atomization.

This is a general equation which covers both steady state running conditions and transient running conditions except that the short-term delay flow correction modified by the correction factor x and the long-term delay flow correction modified by the correction factor y are added to the cylinder air equivalent pulse width Avip only during transient conditions.

Transient conditions are determined from the rates of change of the throttle opening Tvo and the basic injection pulse width Tp.

Figure 9:
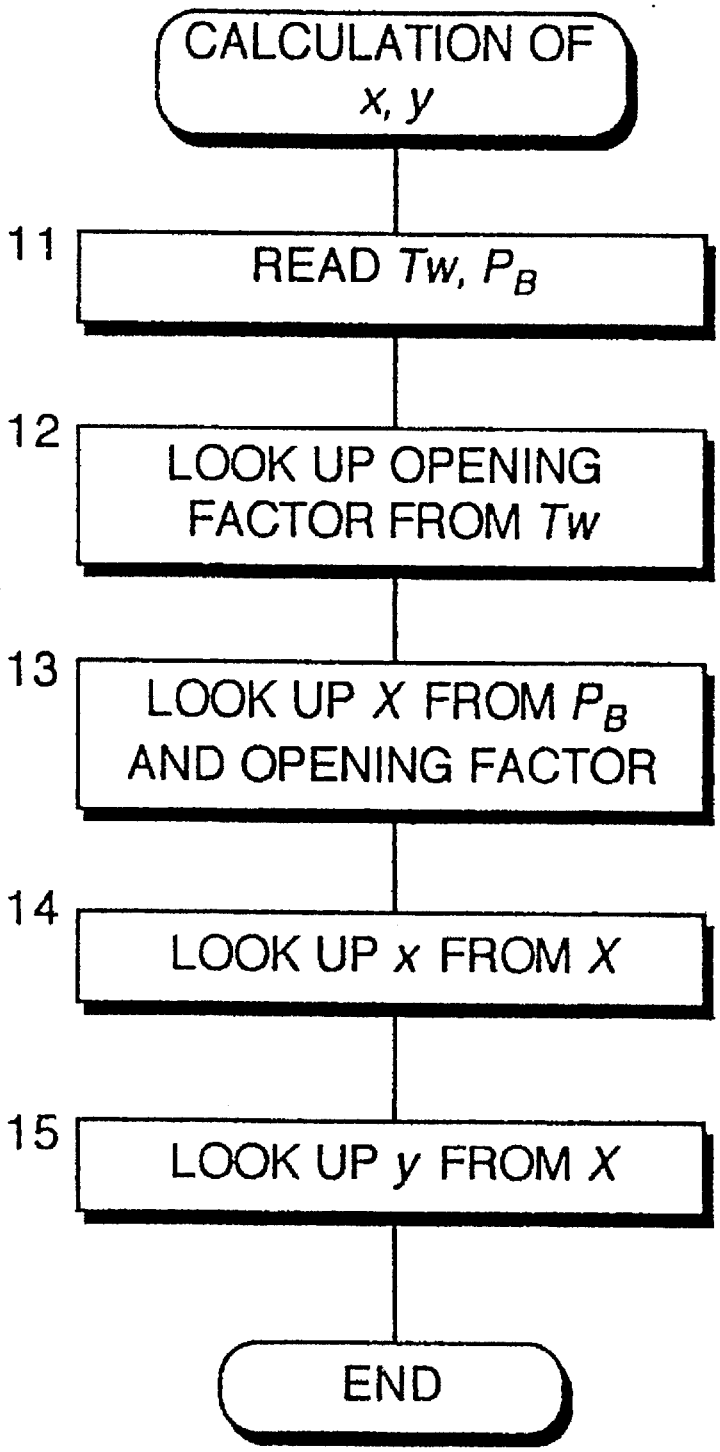
FIG. 9 is a flowchart describing a process of computing atomization correction factors x and y according to this invention.

FIG. 9 shows a subroutine for calculating the atomization correction factors x, y in the step 8.

Figure 10:
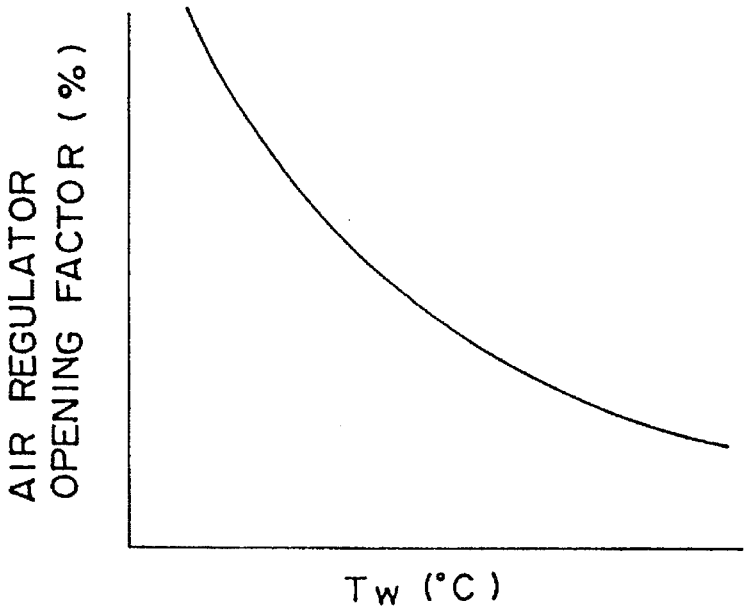
FIG. 10 is a graph showing a relation between cooling water temperature Tw and an opening factor of an air regulator according to this invention.

First, the cooling water temperature Tw and intake negative pressure $P_B$ are read (step 11), and the opening of the air regulator 8 is found from the cooling water temperature Tw by looking up a table shown in FIG. 10 (step 12).

Figure 11:
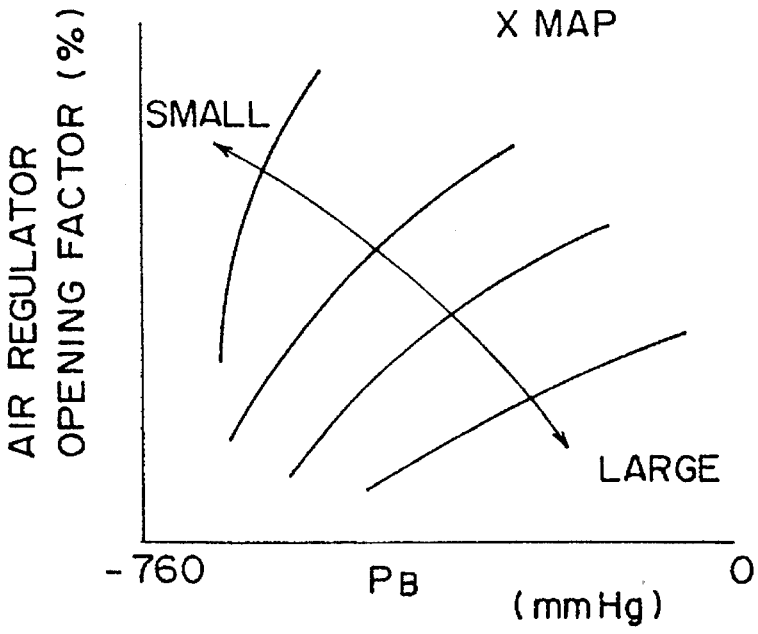
FIG. 11 is a graph showing a relation of a spray particle diameter X to an intake negative pressure $P_B$ and the opening factor according to this invention.

The particle diameter X of the fuel spray from the injector 5 is then found from this opening and the intake negative pressure $P_B$ by looking up a map shown in FIG. 11 (steps 12, 13).

The particle diameter X becomes smaller the higher the intake negative pressure $P_B$, or the larger the opening of the air regulator 8, i.e. the higher the flowrate of the supplemental air.

Figure 12:
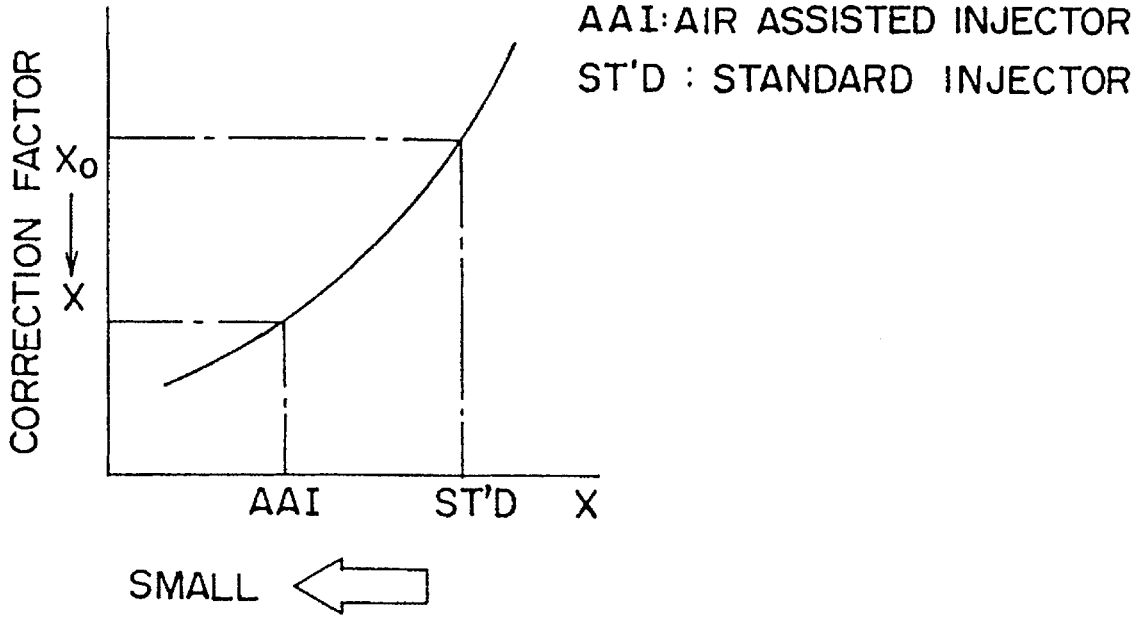
FIG. 12 is a graph showing a relation between the spray particle diameter X and the atomization correction factor x according to this invention.
Figure 13:
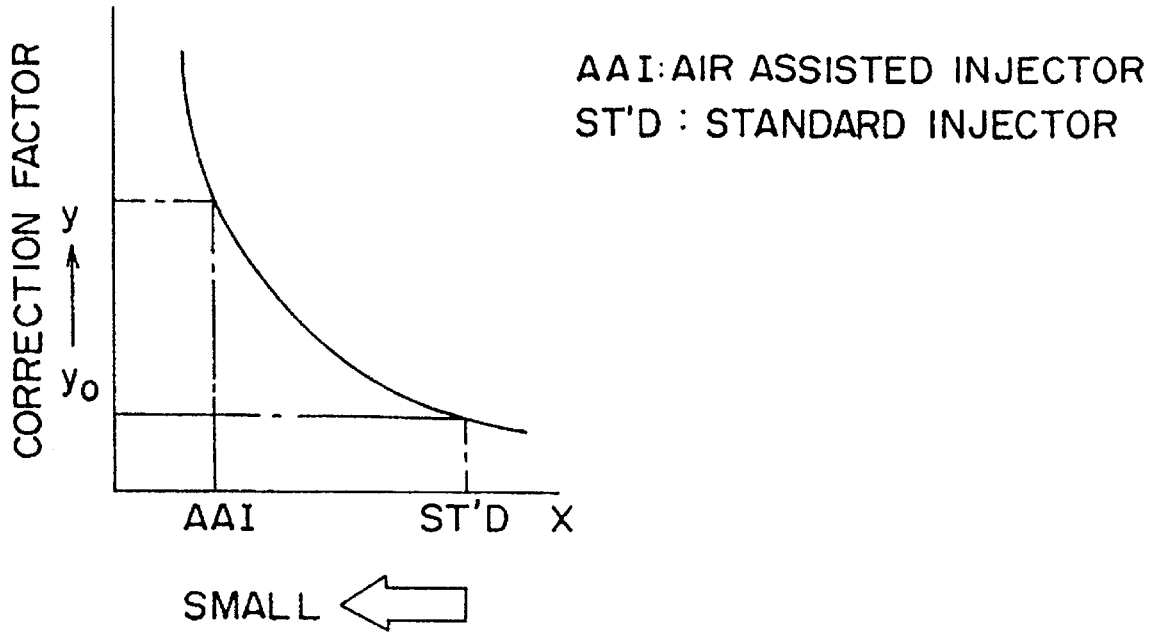
FIG. 13 is a graph showing a relation between the fuel spray particle diameter X and the atomization correction factor y according to this invention.

The atomization correction factors x, y are then found from the particle diameter X by looking up tables shown in FIG. 12 and FIG. 13 (steps 14, 15).

As shown in FIG. 12, the atomization correction factor x is set so that it decreases the smaller the particle diameter X is compared to a basic particle diameter $X_{STD}$ which is the particle diameter for a standard injector.

Conversely, the atomization correction factor y is set so that it increases the smaller the particle diameter X is compared to the basic particle diameter $X_{STD}$.

In other words, a modification is made so as to decrease the short-term delay flow correction and increase the long-term delay flow correction the smaller the spray particle diameter X (i.e. the higher the degree of atomization).

The reason why the correction is thus arranged is as follows.

Figure 14:
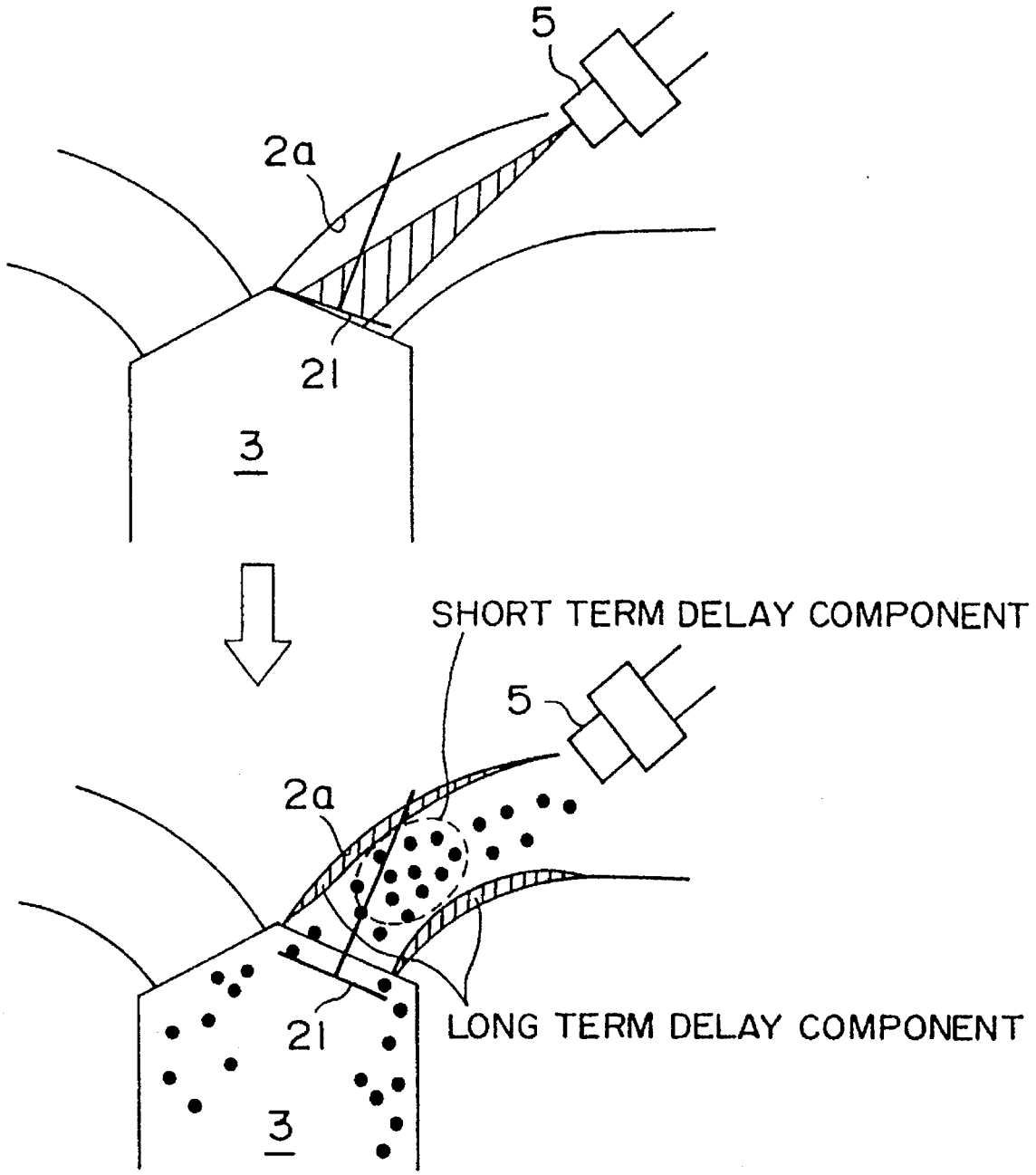
FIG. 14 shows schematic vertical sectional views of an engine describing fuel atomization by a standard injector and wall flow formation.
Figure 15:
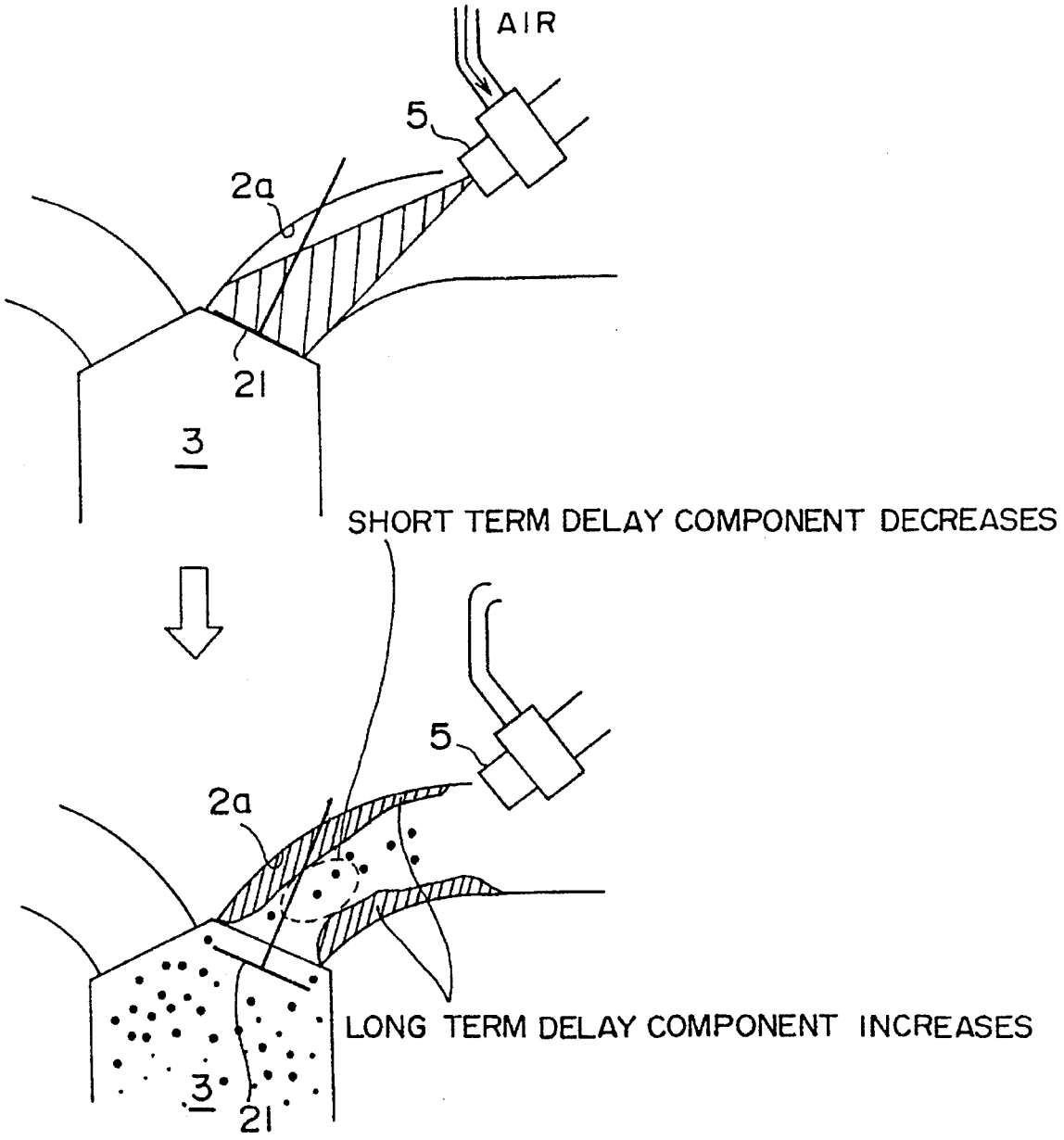
FIG. 15 shows schematic vertical sectional views of an engine describing fuel atomization by an air-assisted injector and wall flow formation.
Figure 16A:
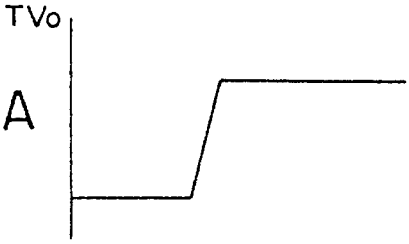
FIGS. 16(*a*)–(*d*) are a set of graphs showing (a) throttle opening during acceleration, air-fuel ratio (b) before correction, and (d) after correction, and (c) fuel injection pulse width for the purpose of describing an effect of this invention.
Figure 16B:
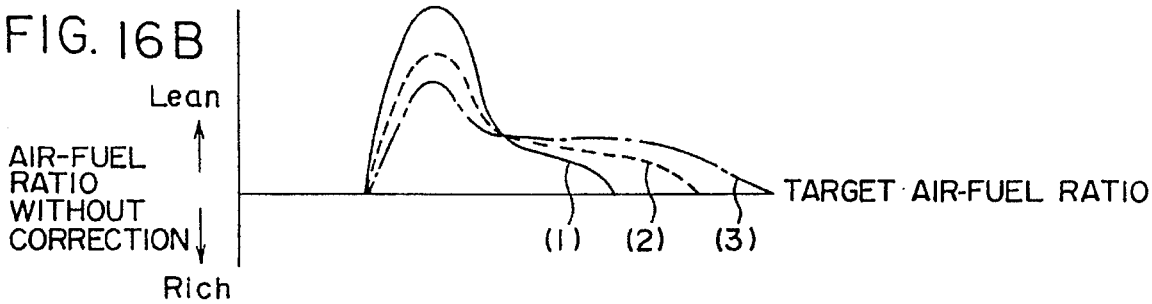
Figure 16C:
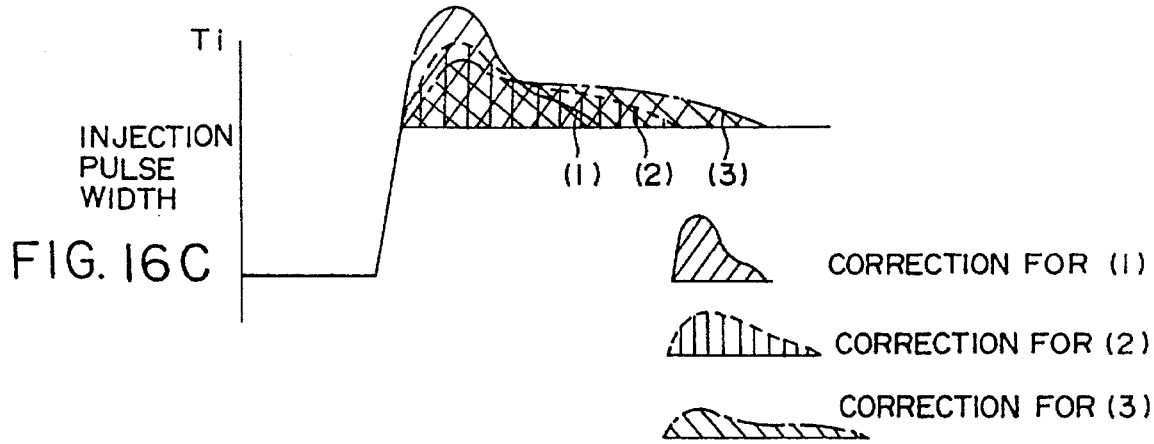
Figure 16D:
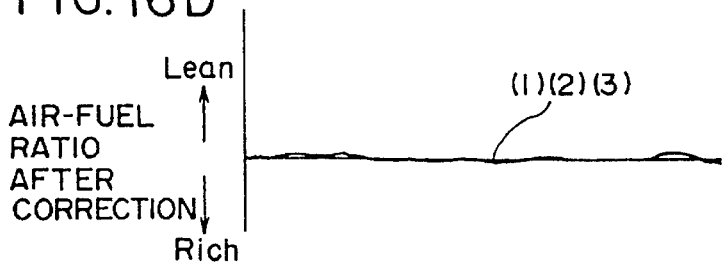

The air-assisted injector 5 shown in FIG. 15 has a wider spray single than the standard injector shown in FIG. 14, so the fuel tends to adhere more easily to the wall of the intake port 2*a* and the long-term delay flow correction increases. On the other hand, atomized fuel tends to be carried more easily in the air flow from the intake port 2*a*, so it does not accumulate so easily inside the port 2*a* and the short-term delay flowrate decreases.

Due to this type of flow delay when the fuel is atomized, the short-term delay flow correction has to be decreased, and the long-term delay flow correction has to be increased, for an air-assisted injector in comparison to a standard injector.

Another possible reason why the long-term delay flow increases is that the penetrating power of the fuel spray decreases the smaller the fuel particle diameter, so it becomes more difficult for the particles to reach the cylinder 3 and the amount of fuel adhering to the port walls consequently increases.

The effect of this embodiment will now be described with reference to FIG. 16. FIG. 16 shows what happens to the change of air-fuel ratio under the same acceleration conditions as those of the conventional example shown in FIG. 22. In this figure, curve (1) is for a standard injector, curve (2) is for an air-assisted injector where the particle diameter is relatively large, and curve (3) is for an air-assisted injector where the particle diameter is relatively small. The degree of atomization increases in the order (1)–(2)–(3).

As can be seen by comparing the injection pulse width Ti on FIGS. 16(*c*) and 22(*c*), the delay flow correction varies together with the degree of atomization of the fuel in FIGS. 16(*a*)–(*d*). In the case of the air-assisted injector (2) where there is a higher degree of atomization than that of the standard injector (1), the delay flow correction decreases in the initial stage of acceleration and increases in the later stage of acceleration compared to the situation with the standard injector as shown by the dotted line in the figure. By varying the correction in this way, the air-fuel ratio during transient conditions is brought within tolerance for the target air-fuel ratio as in the case of a standard injector, as shown by the FIG. 16(*d*).

Similarly, in the case (3) of an air-assisted injector with a high degree of atomization, the decrease of the delay flow correction in the initial stage of acceleration and the increase of the delay flow correction in the later stage of acceleration is still more pronounced, as shown by the broken line. Here too, the air-fuel ratio is brought within tolerance for the target air-fuel ratio as shown by the FIG. 16(*d*).

FIG. 16(*b*) shows the response delay in the air-fuel ratio during transient conditions when the air-fuel ratio is not corrected by the delay flow correction. The map of the delay flow correction is set for the case (1) of a standard injector. For the air-assisted injectors of cases (2) and (3), the map values are modified using the correction factors x and y corresponding to the degree of atomization, and the delay flow correction is varied depending on the waveform of the response delay. Therefore, even of atomization if fuel is enhanced by an air-assisted injector, the air-fuel ratio during transient conditions does not deviate from the target air-fuel ratio.

Figure 17:
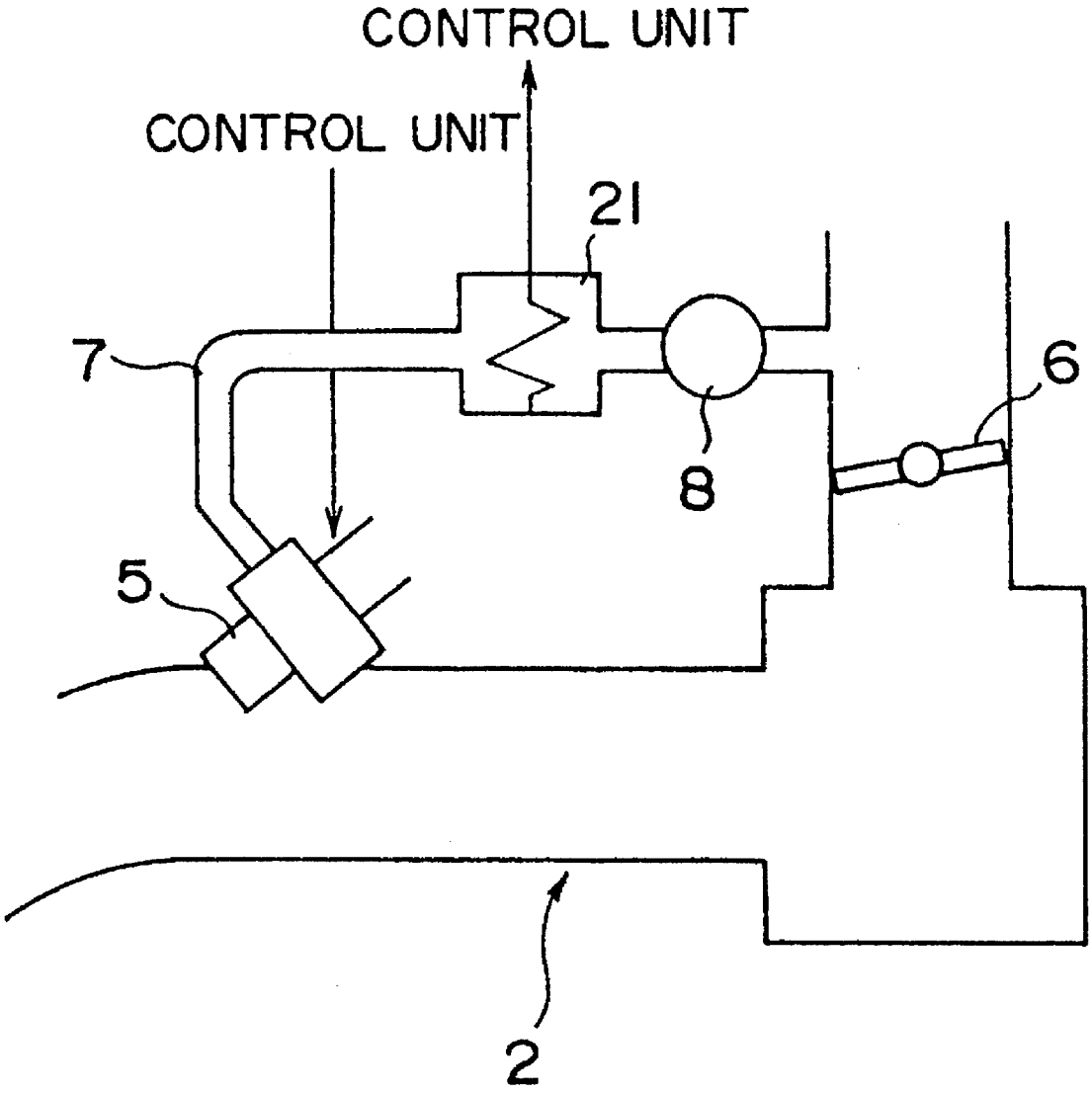
FIG. 17 is a schematic diagram of a fourth embodiment of this invention.
Figure 18:
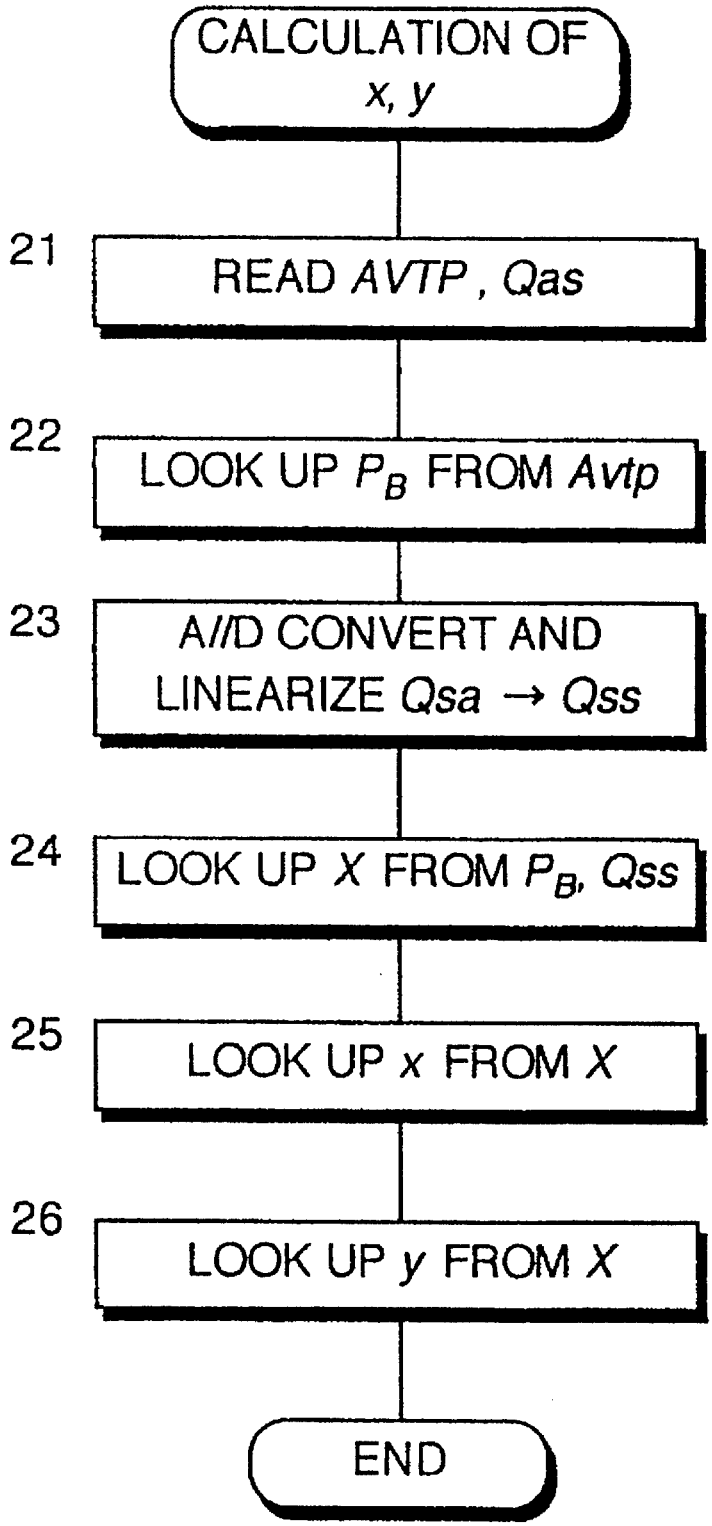
FIG. 18 is a flowchart describing a process of computing atomization correction factors x and y according to the fourth embodiment of this invention.

FIG. 17 and FIG. 18 show a fourth embodiment of this invention. According to this embodiment, a sub-air flow meter 21 is installed downstream from the air regulator 8. In this case, steps 21–24 of the flowchart shown in FIG. 18 are different from those of the flowchart of FIG. 9.

Figure 20:
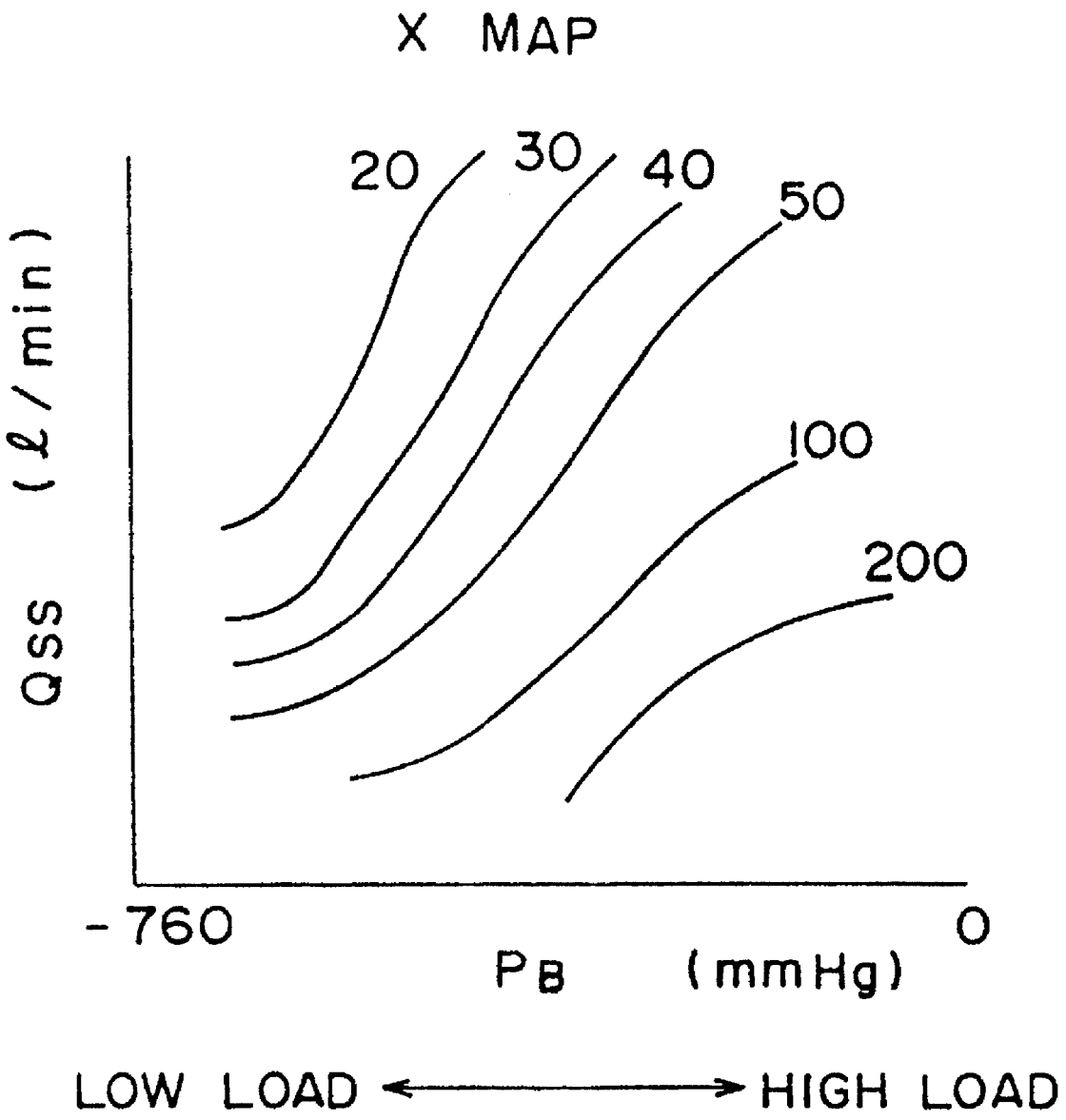
FIG. 20 is a graph of the fuel spray particle diameter according to the fourth embodiment.
Figure 21A:
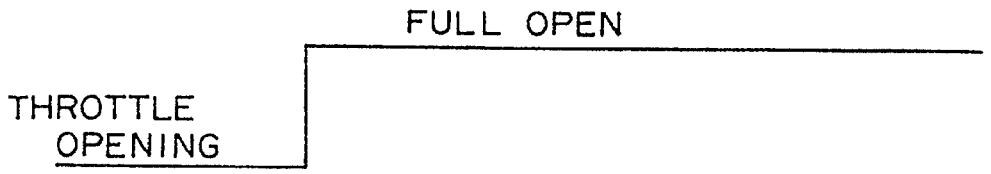
FIG. 21A PRIOR ART
FIGS. 21(*a*)–(*c*) are a set of graphs showing a throttle opening, (c) the air-fuel ratio, and (b) the correction amount for the purpose of describing short-term and long-term delay flow correction according to a prior art.
Figure 21B:
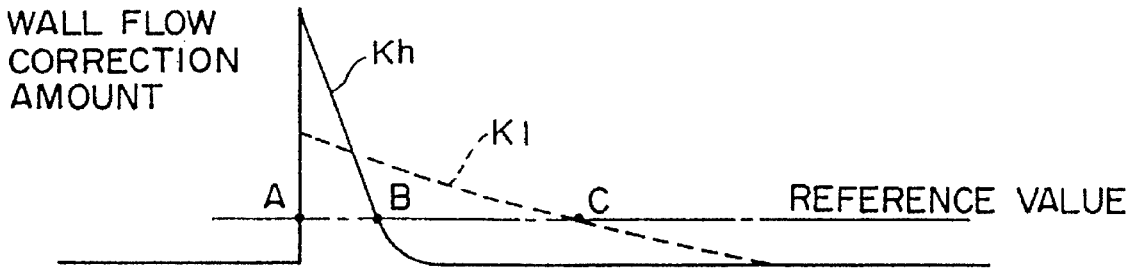
FIG. 21B PRIOR ART
Figure 21C:
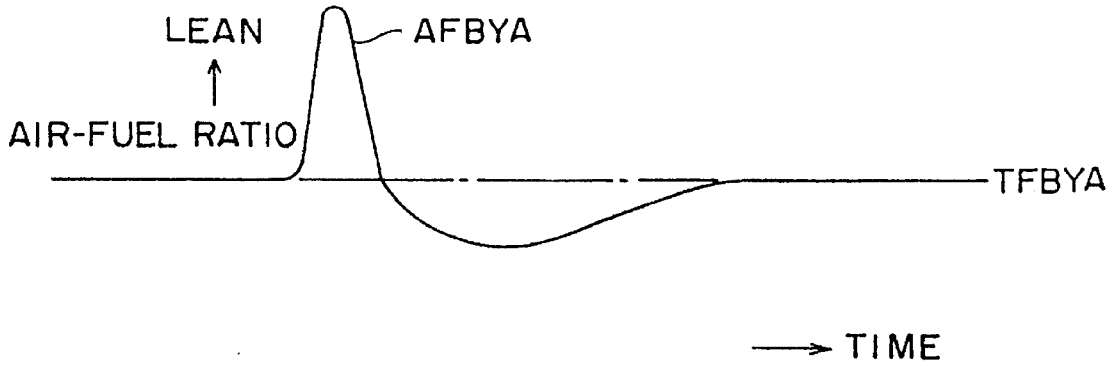
FIG. 21C PRIOR ART
Figure 22A:
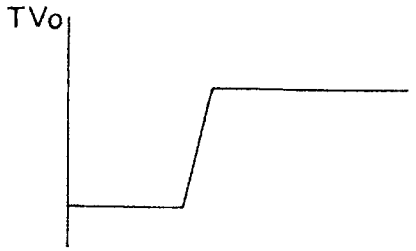
FIG. 22A PRIOR ART
FIGS. 22(*a*)–(*d*) are a set of graphs showing (a) the throttle opening, (b) the air-fuel ratio before correction and (d) after correction, and (c) the fuel injection pulse width during acceleration according to the prior art.
Figure 22B:
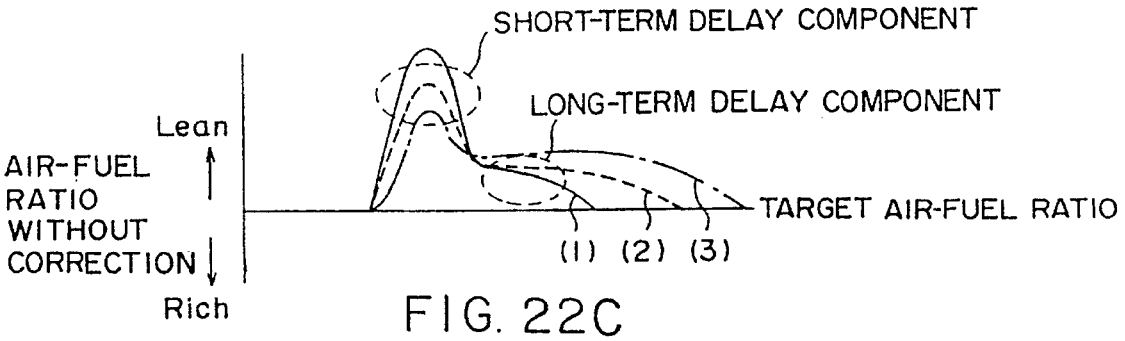
FIG. 22B PRIOR ART
Figure 22C:
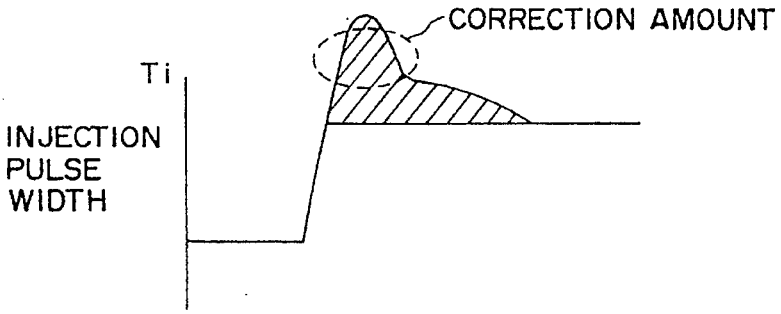
FIG. 22C PRIOR ART
Figure 22D:
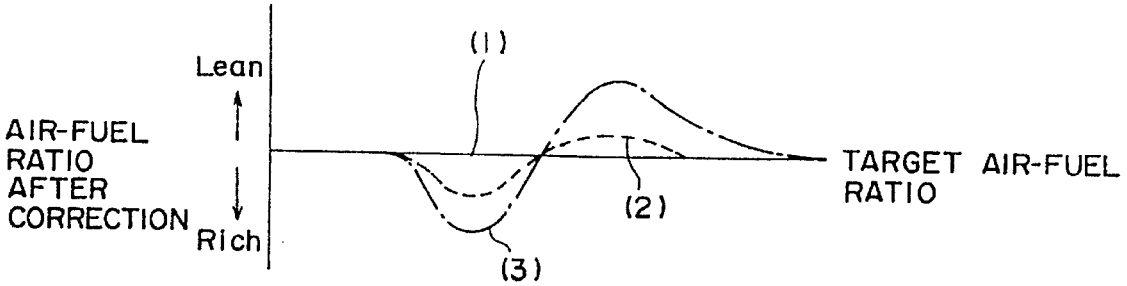
FIG. 22D PRIOR ART

According to this embodiment, the amount of the supplemental air is detected by the sub-air flow meter 21, so the vertical axis of the map of spray particle diameter shown in FIG. 20 (units of diameter are ram) becomes supplemental air flowrate Qss which is different from the case of FIG. 11 (steps 23, 24).

Regarding the output Qsa of the sub-air flow meter, the process of performing A/D conversion, and using the linearized value to find the supplemental air flowrate Qss, is the same as that for the air flow meter output Qa (step 23).

Also, as the negative intake pressure $P_B$ is found from the cylinder air equivalent pulse width Avtp by looking up a table (steps 21, 22), the pressure sensor is omitted.

Figure 19:
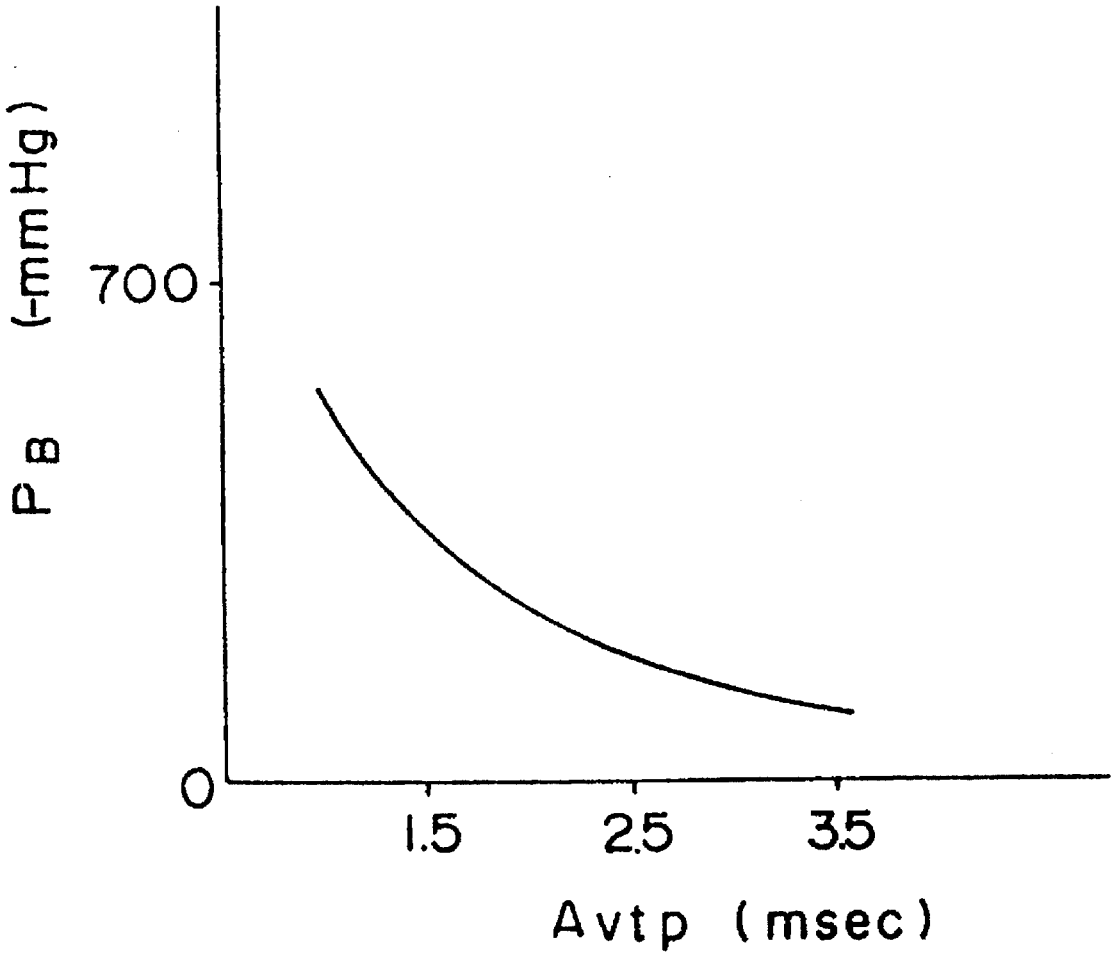
FIG. 19 is a graph showing a relation between a cylinder air equivalent pulse width Avtp and the intake negative pressure $P_B$ according to the fourth embodiment.

The relation shown in FIG. 19 exists between Avtp and the negative intake pressure $P_B$, the negative pressure $P_B$ decreasing the larger the value of Avtp. Therefore, if this relation is first determined, Avtp can be replaced by the negative intake pressure $P_B$.

As according to this embodiment, the supplemental air flowrate is measured by the sub-air flow meter 21, the computational precision of the atomization correction factors x and y is further improved compared to that of the above three embodiments.

The invention has been described in the case of the aforementioned embodiments, however it will of course be understood that it is not limited to these embodiments, various design modifications being possible within the spirit and scope of the invention.

For example, the situation has been described wherein both delay flow correction map values were modified depending on the fuel spray particle diameter, however it is also within the scope of the invention to modify only one of these values depending on the particle diameter. In this case, if for example only the map value for the short-term delay flow correction is modified, the air-fuel ratio in the initial stage of acceleration will be closer to the target air-fuel ratio than in the conventional case, whereas if only the map value for the long-term delay flow correction is modified, the air-fuel ratio in the later stage of acceleration will be closer to the target air-fuel ratio than in the conventional case.

Further, according to the above embodiments, intake air upstream from the throttle valve is used as the supplemental air, however an air pump may be used as the source of the supplemental air. In this case, the computation of fuel spray particle diameter will depend on the difference or ratio of the supplemental air supply pressure and the intake air passage pressure downstream from the throttle valve, and on the supplemental air flowrate.

According to the above embodiments, the case has been described where supplemental air is used to promote atomization of the fuel spray particles, however other means of promoting atomization may also be used. For example, the atomization of fuel particles could be promoted by an ultrasonic oscillator installed at the injector outlet, or by a heater installed in the injector to raise the fuel temperature. The degree of atomization of the fuel may then be estimated from the frequency of the voltage applied to the ultrasonic oscillator, or from the power supplied to the heater, and this degree used to modify the short-term delay flow correction and long-term delay flow correction for a standard injector as before. Still further, atomization of the fuel may be promoted by decreasing its viscosity.

The embodiments of this invention in which an exclusive property or privilege is claimed are defined as follows:

1. An engine fuel injection controller for use with an engine including a cylinder, an intake passage provided with an intake valve for aspirating air into said cylinder, a throttle for regulating an air flowrate in said passage, an injector situated between said throttle and said intake valve for injecting fuel into said passage, and means for promoting atomization of the fuel spray from said injector, said controller comprising:

means for detecting engine running conditions;

control means functioning to compute a basic fuel injection amount based on said engine running conditions, store short-term delay flow corrections depending on various engine running conditions, each of said corrections corresponding to a delay of fuel flow in said passage with a relatively fast time constant, store long-term delay flow corrections depending on various engine running conditions, each of said corrections corresponding to a delay of fuel flow in said passage with a relatively slow time constant, read a stored short-term delay flow correction based on said detected engine running conditions, read a stored long-term delay flow correction based on said detected engine running conditions, estimate a particle diameter of the fuel spray, modify at least one of said read delay flow corrections such that said long-term delay flow correction is increased, and said short-term delay flow correction is decreased, as the particle diameter of the fuel spray is smaller, correct said basic fuel injection amount based on said modified delay flow corrections to determine a corrected amount of fuel; and means for controlling said injector to inject said corrected amount of fuel.

2. A fuel injection controller as defined in claim 1 wherein said atomization promoting means comprises a device for mixing supplemental air with the fuel injected by said injector, and said fuel injection controller further comprising means for detecting a flowrate of the supplemental air, the control means further functioning to determine either the difference or ratio of a pressure of the supplemental air and a pressure in said passage downstream from said throttle valve to estimate the particle diameter based on said pressure difference or ratio and said supplemental air flowrate.

3. An engine fuel injection controller for use with an engine comprising a cylinder, an intake passage provided with an intake valve for aspirating air into said cylinder, a throttle for regulating an air flowrate in said passage, and injector situated between said throttle and said intake valve for injecting fuel into said passage, and means for promoting atomization of the fuel spray from said injector, said controller comprising:

means for detecting engine running conditions;

means for detecting a temperature of a part of said passage where sprayed fuel has adhered;

a control means functioning to compute a basic fuel injection amount based on aid engine running conditions, store short-term delay flow corrections depending on various engine running conditions and temperatures of the part where fuel is adhering, each of said corrections corresponding to a delay of fuel flow in said passage with a relatively fast time constant, store long-term delay flow corrections depending on various engine running conditions and temperatures of the part where fuel is adhering, each of said corrections corresponding to a delay of fuel flow in said passage with a relatively slow time constant, read a stored short-term delay flow correction based on said detected engine running conditions and said detected temperature, read a stored long-term delay flow correction based on said detected engine running conditions and said detected temperature, estimate a particle diameter of the fuel spray, modify at least one of the read delay flow corrections such that said long-term delay flow correction is increased, and said short-term delay flow correction is decreased as the particle diameter of the fuel spray is smaller, correct said basic injection amount based on said modified delay flow corrections to determine a corrected amount of fuel; and means for controlling said injector to inject said corrected amount of fuel.

4. A fuel injection controller as defined in claim 3, wherein said temperature detecting means comprises means for detecting a temperature of said intake valve.

5. A fuel injection controller as defined in claim 3, wherein aid temperature detecting means comprises means for detecting an engine cooling water temperature, and means for detecting a temperature of said intake passage, said control means further functioning to calculate an equilibrium temperature of said part from said cooling water temperature and said intake passage temperature, and to apply a first order delay at a predetermined rate to said equilibrium temperature.

6. A fuel injection controller as defined in claim 3, wherein said temperature detecting means comprises means for detecting an engine cooling water temperature, said control means further functioning to set an initial value-of the temperature of said part when the engine starts up, and to compute the temperature of said part from said set initial value and said cooling water temperature.

* * * * *